US008911114B2

(12) United States Patent
Tokarz et al.

(10) Patent No.: US 8,911,114 B2
(45) Date of Patent: Dec. 16, 2014

(54) RETROFIT REFLECTOR FOR A FIXTURE

(71) Applicants: Steve Tokarz, Superior Township, MI (US); William Turnau, Canton, MI (US); William Runge, Canton, MI (US)

(72) Inventors: Steve Tokarz, Superior Township, MI (US); William Turnau, Canton, MI (US); William Runge, Canton, MI (US)

(73) Assignee: American Green Technology, Southbend, IN (US)

( * ) Notice: Subject to any disclaimer, the term of this patent is extended or adjusted under 35 U.S.C. 154(b) by 38 days.

(21) Appl. No.: 13/683,713

(22) Filed: Nov. 21, 2012

(65) Prior Publication Data

US 2013/0170215 A1 Jul. 4, 2013

Related U.S. Application Data

(60) Provisional application No. 61/562,718, filed on Nov. 22, 2011.

(51) Int. Cl.
*F21V 7/16* (2006.01)

(52) U.S. Cl.
CPC ..... *F21V 7/16* (2013.01)
USPC ..... 362/278; 362/320; 362/347; 362/306

(58) Field of Classification Search
USPC ..... 362/277, 278, 320, 347, 254, 306
See application file for complete search history.

(56) References Cited

U.S. PATENT DOCUMENTS

| | | | | |
|---|---|---|---|---|
| 5,615,943 | A * | 4/1997 | Coldren | 362/220 |
| 6,053,624 | A * | 4/2000 | Cronk | 362/347 |
| 2001/0004320 | A1 * | 6/2001 | Wood | 362/297 |
| 2010/0046214 | A1 * | 2/2010 | Kassay et al. | 362/217.05 |
| 2011/0063851 | A1 * | 3/2011 | Yager | 362/296.01 |

* cited by examiner

*Primary Examiner* — Laura Tso
(74) *Attorney, Agent, or Firm* — Carlson, Gaskey & Olds P.C.

(57) ABSTRACT

A retrofit reflector for a fixture that may be utilizing an induction lamp, mounts the lamp at a point of zero bending moment on the reflector. The reflector bends widthwise in the fixture to fit within various widths of fixtures while maintaining the lamp along the zero bending moment on the reflector.

12 Claims, 3 Drawing Sheets

RETROFIT REFLECTOR FOR A FIXTURE

TECHNICAL FIELD

This application relates to lighting fixtures and more particularly to retrofit reflectors for lighting fixtures.

BACKGROUND

As lighting becomes more efficient as evidenced, for instance, by the introduction of LED technology into homes and businesses, other forms of lighting technology are being left behind. For instance, incandescent light lamps as they exist today, are being legislated out of existence because of their energy inefficiency. As a result, the fixtures for use with old technology lamps that are less energy efficient than new technology lamps may not be able to fit the new technology lamps therein. Fluorescent lamps in particular need new fixtures to fit their narrower profiles and electronic ballasts.

SUMMARY OF THE INVENTION

According to an embodiment disclosed herein, a retrofit reflector for a fixture that may be utilizing an induction lamp, mounts the lamp along a zero bending moment on the reflector. The reflector bends widthwise in the fixture to fit within various widths of fixtures while maintaining the lamp at along the zero bending moment on the reflector.

According to a further embodiment disclosed herein, a method of mounting a retrofit reflector includes the steps of mounting a lamp to a point of zero bending on a base of the retrofit reflector, flexing arms of the reflector that extend from the base, and bending the base of the reflector while maintaining the lamp at a point of zero bending as the arms flex to fit the retrofit reflector with a fixture.

These and other features of the present invention can be best understood from the following specification and drawings, the following of which is a brief description.

DETAILED DESCRIPTION OF THE PREFERRED EMBODIMENT

Figure 1:
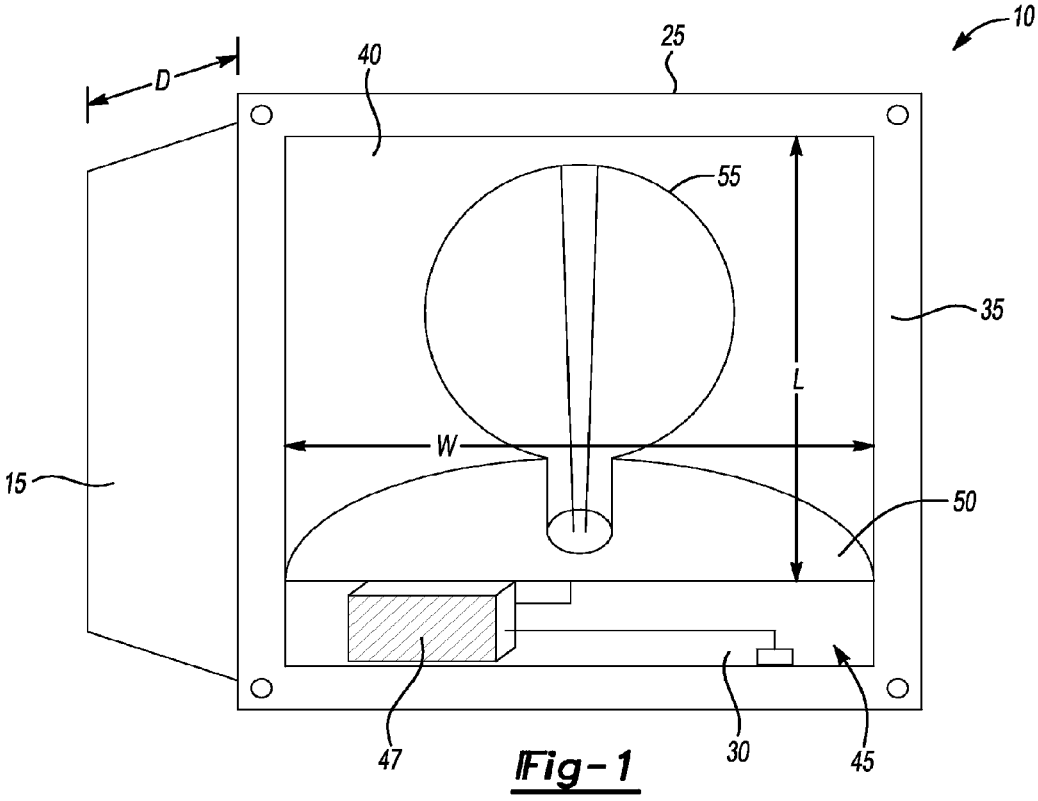
FIG. 1 is a perspective view of a light fixture in which a high pressure sodium lamp is mounted.

Referring to FIG. 1, the fixture 10 is to be retrofitted as shown. The fixture has a left side 15, a right side 20, a top side 25, bottom side 30, back 33, an attachment flange 35 for attaching to a lens (not shown), an old reflector 40, an electronics compartment 45, electronics 47 for controlling a lamp, and a separator plate 50 separating the electronics 47 from exemplary high intensity discharge ("HID") lamp 55 that is to be replaced.

Figure 2:
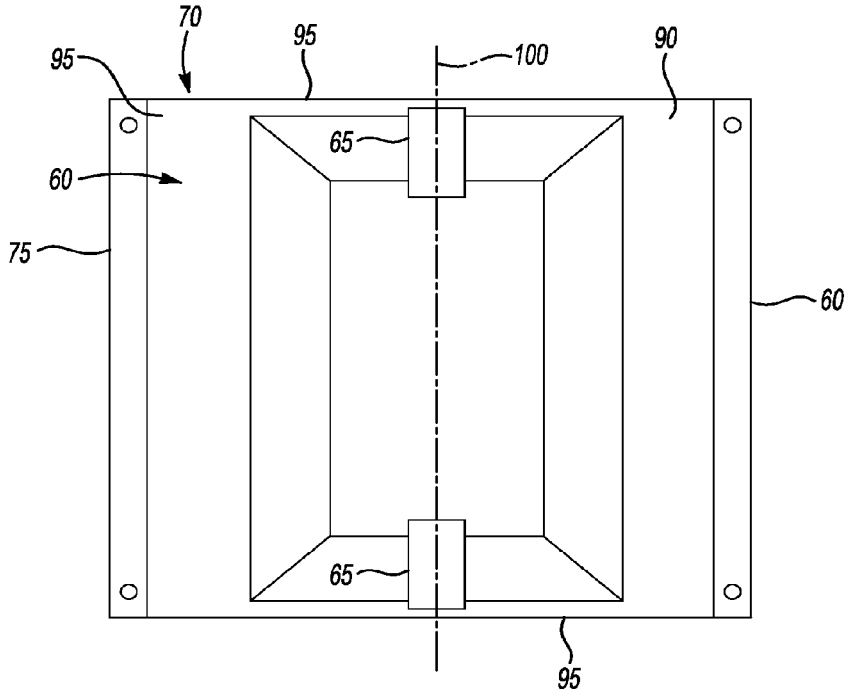
FIG. 2 shows a retrofit reflector with an induction lamp for use within the fixture of FIG. 1.

HID lamp 55, for instance, may be less energy efficient than induction lamp 60 (see FIG. 2). HID fixtures or luminaires, for instance, typically used in parking lots, pole lights and other commercial/industrial settings will need flexible forms of retrofitting with more energy efficient lamps because the size of fixtures 10 holding HID and other types of lamps varies.

Referring now to FIG. 2, an energy-efficient induction lamp 60 has a rectangular shape with external magnets 65 that create and induction field to stimulate plasma (not shown) in the induction lamp 60 to create light.

A retrofit reflector 70 is designed to be placed in the fixture 10 in FIG. 1. The retrofit reflector has a left mounting lip 75, a right mounting lip 80, a left reflector arm 85, a right reflector arm 90, a base 95, and a bending axis 100. The left mounting lip 75 attaches to the left reflector arm 85 which attaches to the base 95. Similarly, the right mounting lip 80 attaches to the right reflector 90 to attach to the base 95.

Figure 3:
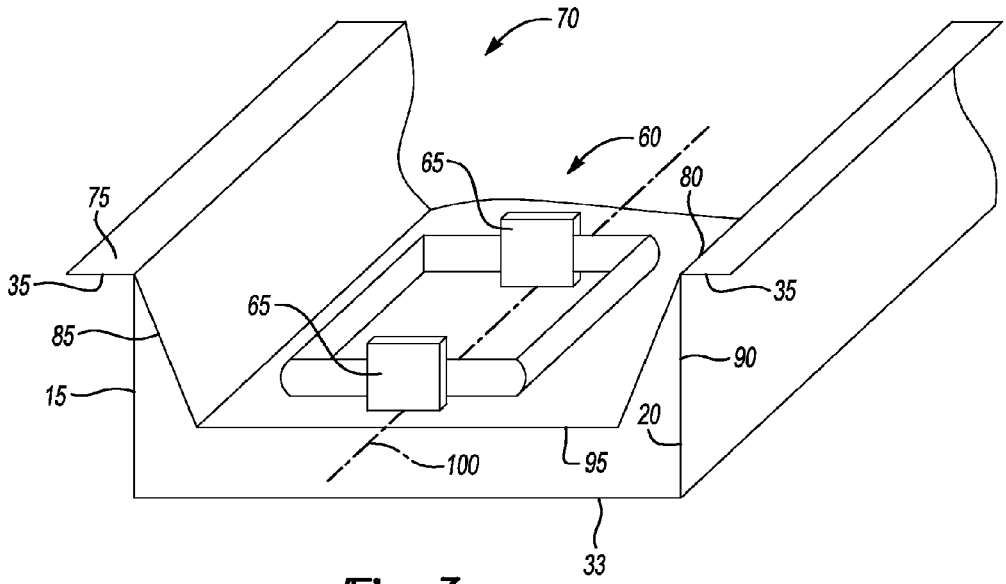
FIG. 3 is a cross-sectional view of the retrofit reflector of FIG. 2, partially in perspective.

Referring to FIG. 3, the relationship between the retrofit reflector 70 and the fixture 10 as shown in FIG. 1 is shown. The left mounting lip 75 is disposed on top of the attachment flange 35 as is the right mounting lip 80. The reflector arms 85, 90 depend downwardly into to the fixture 10 between the left side 15 and the right side 20. The bending axis 100 extends below the magnets 65 of the induction lamp 60 within the back 33.

Figure 4:
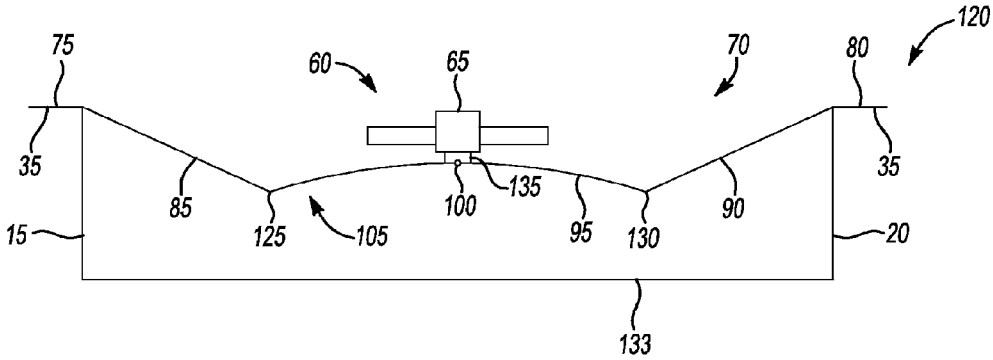
FIG. 4 is a side view of the retrofit reflector of FIG. 3 shown in a larger fixture than the fixture shown in FIG. 1.

Referring now to FIG. 4, the back 133 of the fixture 120 is longer than the back 33 of fixture 10 shown in FIG. 3. The left mounting lip 75 is still attached to the attachment flange 35 on the left side and the right mounting lip 80 is attached to the attachment flange 35 on the right side of the fixture 120. The retrofit reflector 70 because of its flexible nature, flexes at joint 125 between the base 95 and the left reflector arm 85 and the joint 130 between the base 95 and the right reflector arm 90 thereby causing the base 95 to bow upwardly to form a concave surface 105. Concomitantly, the lamp 60 raises upwardly within the fixture 120. The induction lamp 60 is mounted via mount structure 135 along the bending axis 100 which is also a line of zero bending moment so that the lamp 60 is not stressed by the bending of the retrofit reflector 70.

Figure 5:
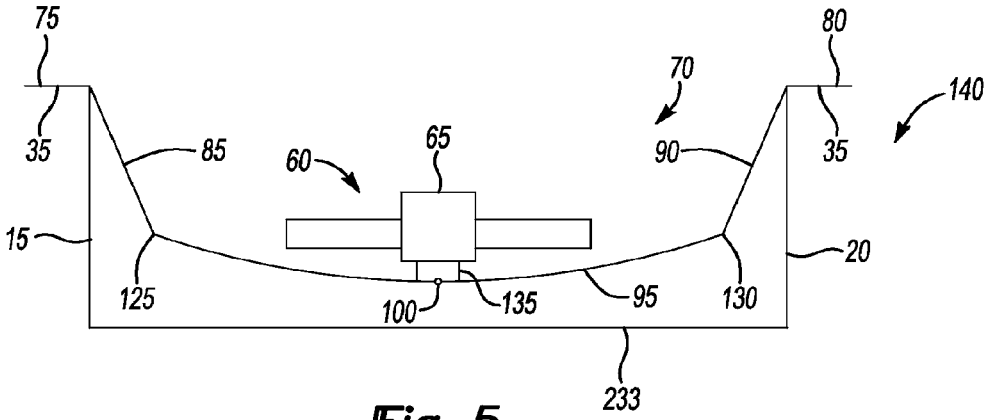
FIG. 5 shows a side view of retrofit reflector and lamp shown in a smaller fixture than the fixture shown in FIG. 1.
Figure 6:
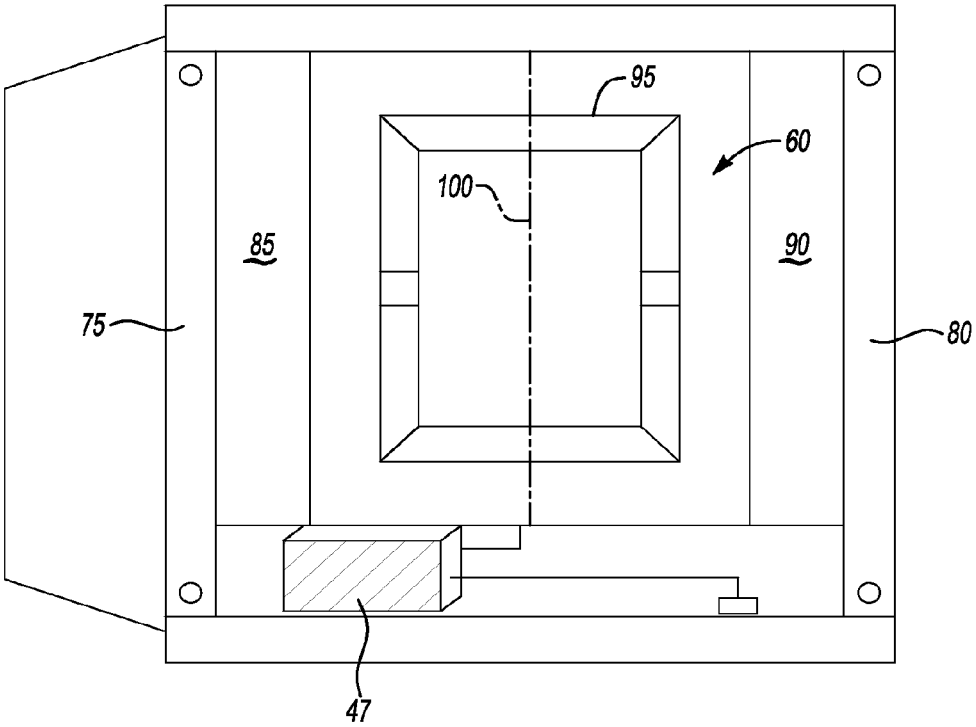
FIG. 6 shows the retrofit reflector and induction lamp in the fixture as shown in FIG. 1.

Referring now to FIG. 5, the retrofit reflector 70 is placed within a fixture 140 having a base 233 that is shorter base 33 shown in FIG. 3. As above, the left mounting lip 75 is placed upon the attachment flange 35 on the left side and the right mount mounting lip 80 is attached to the attachment flange 35 on the right side. Because the base 233 is shorter than the base 33, the arms 85 and 90 are flexed inwardly towards the left side 15 by the left reflector arm and towards the right side 20 by the right reflector arm such that the base 90 is forced to bend concavely towards the back 233. In this situation, the induction lamp 60 is mounted on its base 135 and attached to the base 95 along the bending axis 100 which is placed also at a zero bending moment. Because the base 95 bows concavely relative to the base 233, the induction lamp is deeper within the fixture 140 and the lamp is in the fixture 120 in FIG. 4 or in the fixture 10 shown in FIG. 3. Also, because the lamp 60 is also place along the line of zero bending moment, the lamp 60 is not stressed by the bending of the retrofit reflector 70.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A retrofit reflector for a light fixture, said retrofit reflector comprising:

a flexible reflective body having a base and an arm extending from said base, a bending axis disposed across said body, said axis disposed in parallel with said arm, and a first mount disposed along said bending axis, said mount holding a light lamp, whereby upon flexure of said base, said base bends widthwise in the fixture to fit within various widths of fixtures while maintaining the mount at a zero bending moment along said bending axis such that integrity of said lamp is maintained during said flexure.

2. The retrofit reflector of claim 1 wherein said lamp is an induction lamp.

3. The retrofit reflector of claim 1 further comprising a second mount disposed along said bending moment.

4. The retrofit reflector of claim 1 wherein said base forms a concave shape if said base is longer than a standard base for a different fixture.

5. The retrofit reflector of claim 1 wherein said lamp is elevated relative to said fixture by said concave shape.

6. The retrofit reflector of claim 1 wherein said base forms a convex shape if said base is shorter than a standard base for a different fixture.

7. The retrofit reflector of claim 6 wherein said lamp is lowered relative to said fixture by said convex shape.

8. The retrofit reflector of claim 1 wherein said base has a second arm extending therefrom.

9. A method of retrofitting a fixture with a retrofit reflector comprising the steps of:

mounting a lamp to a line of zero bending moment on a base of the flexible retrofit reflector, said retrofit reflector having an arm on a side thereof, flexing said arm of the retrofit reflector that extends from said base to fit within said fixture, and bending the base of the retrofit reflector while maintaining the lamp at a point of zero bending moment as the arm flexes to fit the retrofit reflector within said fixture.

10. The method of claim 9 further comprising;

flexing a second arm of said retrofit reflector that extends from said base to fit within said fixture.

11. The method of claim 9 further comprising:

flexing said base concavely if said fixture has a base that longer than a base in a standard fixture.

12. The method of claim 9 further comprising:

flexing said base convexly if said fixture has a base that is shorter than a base in a standard fixture.

* * * * *